US012018915B2

(12) United States Patent
Graber

(10) Patent No.: US 12,018,915 B2
(45) Date of Patent: Jun. 25, 2024

(54) CROSSBOW SCOPE WITH BUILT-IN LASER RANGEFINDER

(71) Applicant: Norman Graber, Spencerville, IN (US)

(72) Inventor: Norman Graber, Spencerville, IN (US)

( * ) Notice: Subject to any disclaimer, the term of this patent is extended or adjusted under 35 U.S.C. 154(b) by 430 days.

(21) Appl. No.: 17/574,894

(22) Filed: Jan. 13, 2022

(65) Prior Publication Data

US 2022/0221249 A1 Jul. 14, 2022

Related U.S. Application Data

(60) Provisional application No. 63/137,241, filed on Jan. 14, 2021.

(51) Int. Cl.

| | |
|---|---|
| ***F41G 1/467*** | (2006.01) |
| ***F41B 5/12*** | (2006.01) |
| ***F41G 1/38*** | (2006.01) |
| ***F41G 3/06*** | (2006.01) |
| ***F41G 3/08*** | (2006.01) |

(52) U.S. Cl.

CPC ..... *F41G 1/38* (2013.01); *F41B 5/12* (2013.01); *F41G 1/467* (2013.01); *F41G 3/065* (2013.01); *F41G 3/08* (2013.01)

(58) Field of Classification Search

CPC ..... F41G 1/38; F41G 1/467

USPC ..... 33/265

See application file for complete search history.

(56) References Cited

U.S. PATENT DOCUMENTS

| | | | | |
|---|---|---|---|---|
| 4,617,741 | A * | 10/1986 | Bordeaux | F41G 1/473 124/87 |
| 7,050,102 | B1 * | 5/2006 | Vincent | H04N 21/4325 348/E5.025 |
| 7,506,643 | B2 * | 3/2009 | Holmberg | F41B 5/12 124/87 |
| 7,603,804 | B2 * | 10/2009 | Zaderey | F41G 1/38 42/130 |
| 7,643,132 | B2 * | 1/2010 | Holmberg | F41G 1/473 356/5.02 |
| 8,839,776 | B2 * | 9/2014 | Kingsbury | F41B 5/1426 124/1 |
| 9,057,587 | B2 * | 6/2015 | Roman | F41G 1/38 |
| 9,068,795 | B2 * | 6/2015 | Roman | F41G 3/06 |
| 9,328,996 | B1 * | 5/2016 | Lia | F41G 1/40 |
| 9,377,272 | B2 * | 6/2016 | Morrison | F41G 1/467 |
| 9,441,913 | B1 * | 9/2016 | Donahoe | F41G 1/54 |
| 9,593,907 | B2 * | 3/2017 | Regan | F41G 1/30 |
| 9,766,040 | B2 * | 9/2017 | Roman | F41G 3/165 |
| 9,797,686 | B2 * | 10/2017 | Chesney | F41G 1/467 |
| 11,022,403 | B2 * | 6/2021 | VanCamp | F41G 3/065 |

(Continued)

*Primary Examiner* — George B Bennett

(74) *Attorney, Agent, or Firm* — Brennan, Manna & Diamond, LLC

(57) ABSTRACT

The present invention relates to a crossbow scope with a built-in laser rangefinder. The crossbow scope is designed to be integrated to crossbows during crossbows' manufacturing or retrofitted to existing crossbows. The scope is activated using a push button coupled to the scope and positioned on the crossbow. The scope has a laser diode emitting a laser towards a target and a range sensor for determining a range or distance to the target and a tilt of the crossbow relative to the target. Users can adjust their crossbow position to accommodate the laser reticle within the sight to match the laser beam with the target. The scope improves crossbow shot accuracy while hunting, during competition, shooting practice and more.

20 Claims, 5 Drawing Sheets

(56) References Cited

U.S. PATENT DOCUMENTS

| | | | | |
|---|---|---|---|---|
| 11,391,541 | B1 * | 7/2022 | Kennedy | F41G 1/38 |
| 2017/0284771 | A1 * | 10/2017 | Roman | F41G 1/473 |
| 2021/0310767 | A1 * | 10/2021 | Baker | G02B 26/0816 |
| 2021/0364252 | A1 * | 11/2021 | Heeke | F41B 5/1484 |

* cited by examiner

CROSSBOW SCOPE WITH BUILT-IN LASER RANGEFINDER

CROSS-REFERENCE TO RELATED APPLICATION

The present application claims priority to, and the benefit of, U.S. Provisional Application No. 63/137,241, which was filed on Jan. 14, 2021 and is incorporated herein by reference in its entirety.

FIELD OF THE INVENTION

The present invention relates generally to the field of crossbows. More specifically, the invention relates to a crossbow scope with built-in laser rangefinder. The scope features an integrated laser rangefinder, selectively activated via a button positioned on the crossbow to which the scope is attached. The laser emitted by a laser source of the scope is used by a range sensor for determining actual distance and tilt from a target and allows a user to maximize their accuracy while hunting, shooting competition and more. The scope can be integrated or retrofitted to existing crossbows. Accordingly, the present disclosure makes specific reference thereto. Nonetheless, it is to be appreciated that aspects of the present invention are also equally applicable to other like applications, devices and methods of manufacture.

BACKGROUND

By way of background, bows and arrows, spears, crossbows, guns, and artillery have been used for sport, hunting and military. More specifically, a crossbow is a ranged weapon using an elastic launching device consisting of a bow-like assembly called a prod. Crossbows are often used for hunting and recreational purposes and require a higher degree of stealth and sheer effort to get into position to make the shot. Therefore, precision and accuracy of the shot is difficult. This becomes more difficult due to absence of a rangefinder in conventional crossbows. Individuals generally end up missing a target which may cost them a trophy or a prey. A rangefinder is therefore desired by individuals for improving their shots before competitions and during hunts.

Using conventional crossbows can be dangerous for other individuals as the user using the crossbow may miss the target by a long distance. Individuals desire a device that can assist them with making an accurate shot.

Many individuals enjoy hunting using crossbows and the hunting experience with conventional crossbows is generally disappointing as the individuals can't find and accurately shoot long distance animals. Individuals desire a rangefinder that can be used with their crossbows and used for long distance shots.

Therefore, there exists a long felt need in the art for a rangefinder scope that can be used with conventional crossbows. There is also a long felt need in the art for a crossbow rangefinder scope that can be used for long distance shots. Additionally, there is a long felt need in the art for a scope that can be easily activated by a user using the crossbow. Moreover, there is a long felt need in the art for a rangefinder scope that can be used for all purposes ranging from competitions and target practice to hunting live animals. Further, there is a long felt need in the art for a rangefinder scope for crossbows that help individuals in improving their shots. Finally, there is a long felt need in the art for a crossbow rangefinder scope that enables users to adjust their shot to accommodate a long-range arc to hit a target at a long range distance and improve the accuracy of same.

The subject matter disclosed and claimed herein, in one embodiment thereof, comprises a crossbow scope with a built-in laser rangefinder. The crossbow scope features a laser rangefinder mechanism including a laser diode for transmitting a laser beam towards a target, a range sensor for detecting range and tilt of the crossbow scope relative to the target, a laser reticle for displaying laser beam projection relative to the target image on an eyepiece of the scope, an activation button disposed on the crossbow to which the scope is attached wherein the button is coupled to the scope and is configured to activate the scope when pressed. In use, users can press the button, activate the rangefinder and adjust their crossbow position to accommodate the laser reticle within the sight.

In this manner, the crossbow scope with built-in laser rangefinder of the present invention accomplishes all of the forgoing objectives and provides users with a crossbow rangefinder scope that can be used for long distance shots with conventional crossbows. The rangefinder uses a laser which can be used for all purposes ranging from competitions to hunting animals. The crossbow rangefinder scope enables users to adjust their shot to accommodate a long-range arc to hit a target at long range distances and improves the accuracy of same.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a crossbow scope with a built-in laser rangefinder. The crossbow scope is designed to be integrated or alternatively retrofitted to a crossbow. The crossbow scope further comprising a laser rangefinder mechanism including a laser source for transmitting a laser beam towards a target, a range sensor for detecting range and tilt of the crossbow scope relative to the target, a laser reticle for displaying a laser beam projection relative to the target image on an eyepiece of the scope, an activation button disposed on the crossbow to which the scope is attached wherein the button is coupled to the scope and is configured to actuate the scope when pressed. The scope is configured to display a range value and tilt value of the target relative to the crossbow enabling a user to improve accuracy for a shot towards the target.

In yet another embodiment, a crossbow with an integrated crossbow scope is disclosed. The crossbow is designed to be used by hunters, professional shooters and others for making accurate and effective shots. The crossbow includes an integrated scope with a built-in laser rangefinder. The scope is attached to the crossbow using a rail, and is operable using a push button positioned on the crossbow. The integrated scope further includes a range sensor for detecting and displaying laser beam projection, a target image, a range between the scope and the target and a tilt of the scope relative to the target. The laser beam projection is automatically started when the push button positioned on the crossbow is pushed by a user.

In yet another embodiment, the scope with built-in rangefinder can be integrated or retrofitted to one of a rifle, a shotgun, a pistol, a crossbow, a bow or a paintball gun.

In yet another embodiment of the present invention, a laser rangefinder scope configured to help a user aim accurately at a target is disclosed. The scope is designed to be integrated or retrofitted to an aiming device. The scope further includes a laser source in the form of a laser diode, a range sensor for detecting range and tilt of the scope relative to the target, an activation button disposed on the aiming device to activate the laser source, an eyepiece in correlation with a reticle for displaying laser beam projection and a target image indicating the relative distance between the laser beam projection and the target image.

In yet another embodiment, the laser source emits one or more from Mode 5 Green laser, Mode 8 Green laser, Mode 5 Red laser and Mode 8 Red laser.

In yet another embodiment, the reticle is 104QD holographic reticle red dot and is replaceable.

In yet another embodiment, the scope is waterproof and fog proof, and is made from 1200G shockproof aluminum.

In yet another embodiment, the scope has an eyepiece lens and an objective lens, wherein both the lenses are high grade fully coated optical lenses.

In yet another embodiment, the eyepiece lens has resettable windage and elevation adjustments.

In yet another embodiment, the scope is attached to the crossbow using an integrated rail and is configured to move along the crossbow.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
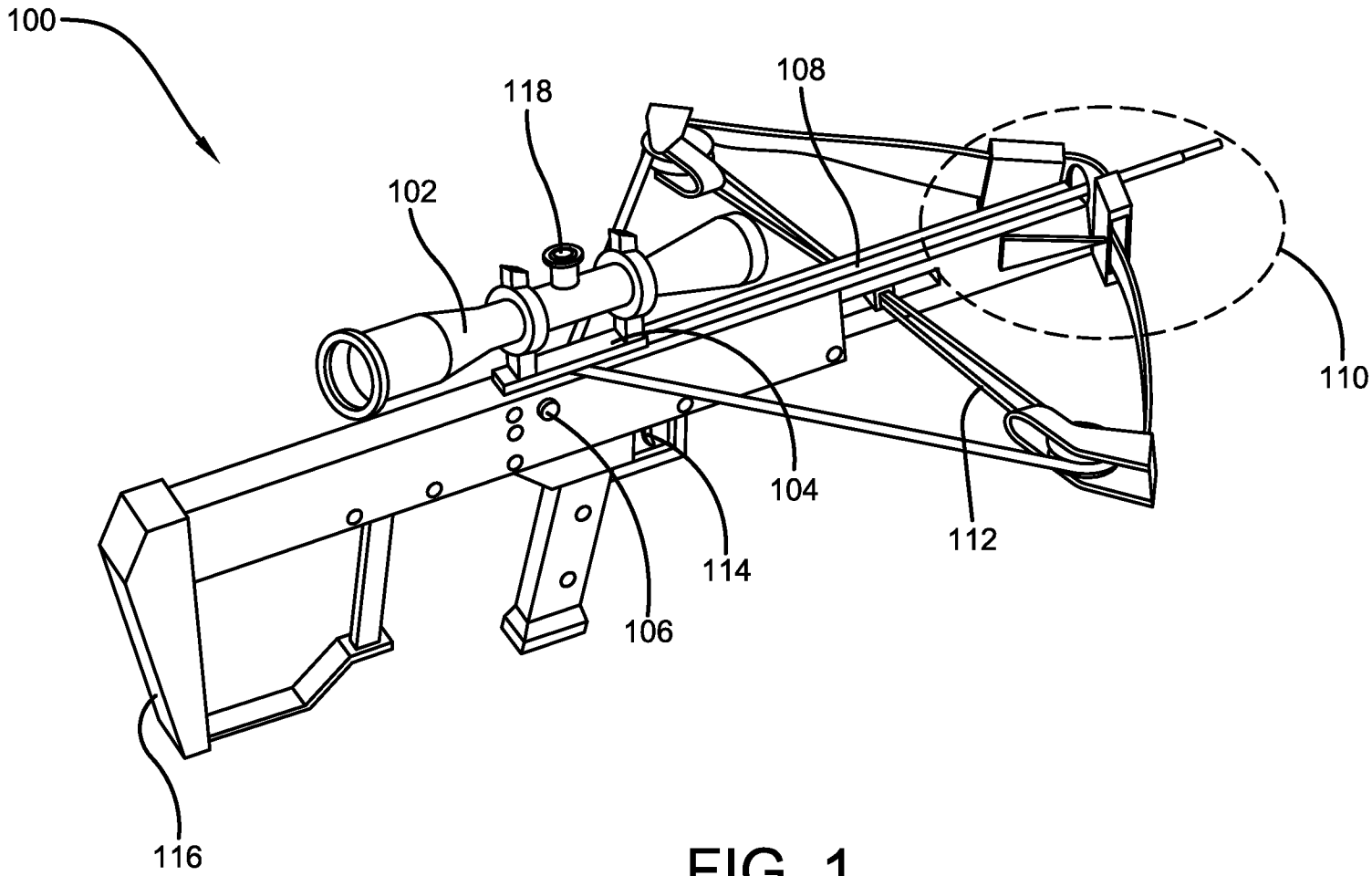
FIG. 1 illustrates a perspective view of one potential embodiment of a crossbow with an integrated rangefinder scope of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention, and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a rangefinder scope that can be used with conventional crossbows. There is also a long felt need in the art for a crossbow rangefinder scope that can be used for long distance shots. Additionally, there is a long felt need in the art for a scope that can be easily activated by a user using the crossbow. Moreover, there is a long felt need in the art for a rangefinder scope that can be used for all purposes ranging from competitions and target practice to hunting live animals. Further, there is a long felt need in the art for a rangefinder scope for crossbows that helps individuals in improving their shots. Finally, there is a long felt need in the art for a crossbow rangefinder scope that enables users to adjust their shot to accommodate a long-range arc to hit a target at a long range distance and improve the accuracy of same.

The present invention, in one exemplary embodiment, is a novel crossbow with an integrated crossbow scope. The crossbow is designed to be used by hunters, professional shooters and others for making accurate and effective shots. The crossbow features an integrated scope with a built-in laser rangefinder, the scope is attached to the crossbow using a rail and is selectively operable using a push or actuation button positioned on the crossbow. The integrated scope further includes a range sensor for detecting and displaying a laser beam projection, a target image, a range between the scope and the target, and a tilt of the scope relative to the target. The laser beam projection is automatically started when an actuation button positioned on the crossbow is pushed by a user.

Referring initially to the drawings, FIG. 1 illustrates a perspective view of the crossbow with integrated rangefinder scope of the present invention in accordance with the disclosed architecture. As shown, the crossbow 100 with integrated rangefinder scope 102 is configured to maximize accuracy for a shot towards a target. The rangefinder scope 102 is designed to determine and display range and shot information by using a laser projection. The rangefinder scope 102 can be integrated to the crossbow 100 during the time of manufacturing of the crossbow 100 or can also be retrofitted to any existing crossbow. The scope 102 is also configured to scan a target towards which the crossbow is targeted.

More specifically, the crossbow 100 has the integrated rangefinder scope 102 that is positioned on the crossbow 100 using a rangefinder rail 104. The rail 104 may allow the scope 102 to horizontally move along the crossbow rail 108 as per preferences of a user using the crossbow 100. A rangefinder activation or actuation button 106 is positioned on the crossbow 100 that can be pushed by the user for activating the scope 102. The scope 102 is selectively activated by pushing the button 106 and a display (as shown in FIG. 2) of the scope 102 displays the target along with relevant information (as shown in FIG. 4) to help the user in making a clear shot.

The crossbow 100 has a front-end portion 110 for shooting a shot towards the target. The front-end portion 110 can include a raiser and other conventional components of a crossbow and therefore are described here for brevity purposes. One or more strings 112 are used for shooting a shot towards the target and the shot is released using a trigger 114. It should be understood that the trigger 114 can be activated by a user without activating the rangefinder scope 102, thereby providing the user to selectively use the scope 102 by pushing the button 106. The crossbow 100 has a butt stock 116 for holding the crossbow 100 during use. Although, crossbow 100 is shown in the present embodiment, it is to be appreciated that the scope 102 can be used with any shooting device capable of shooting towards a target. The scope 102 can be used for finding the range for linear motion, projectile motion or path, and more. Further, the crossbow 100 and the rangefinder scope 102 can be used by shooters during competition, shooting practice, hunting and other bow use.

Figure 2:
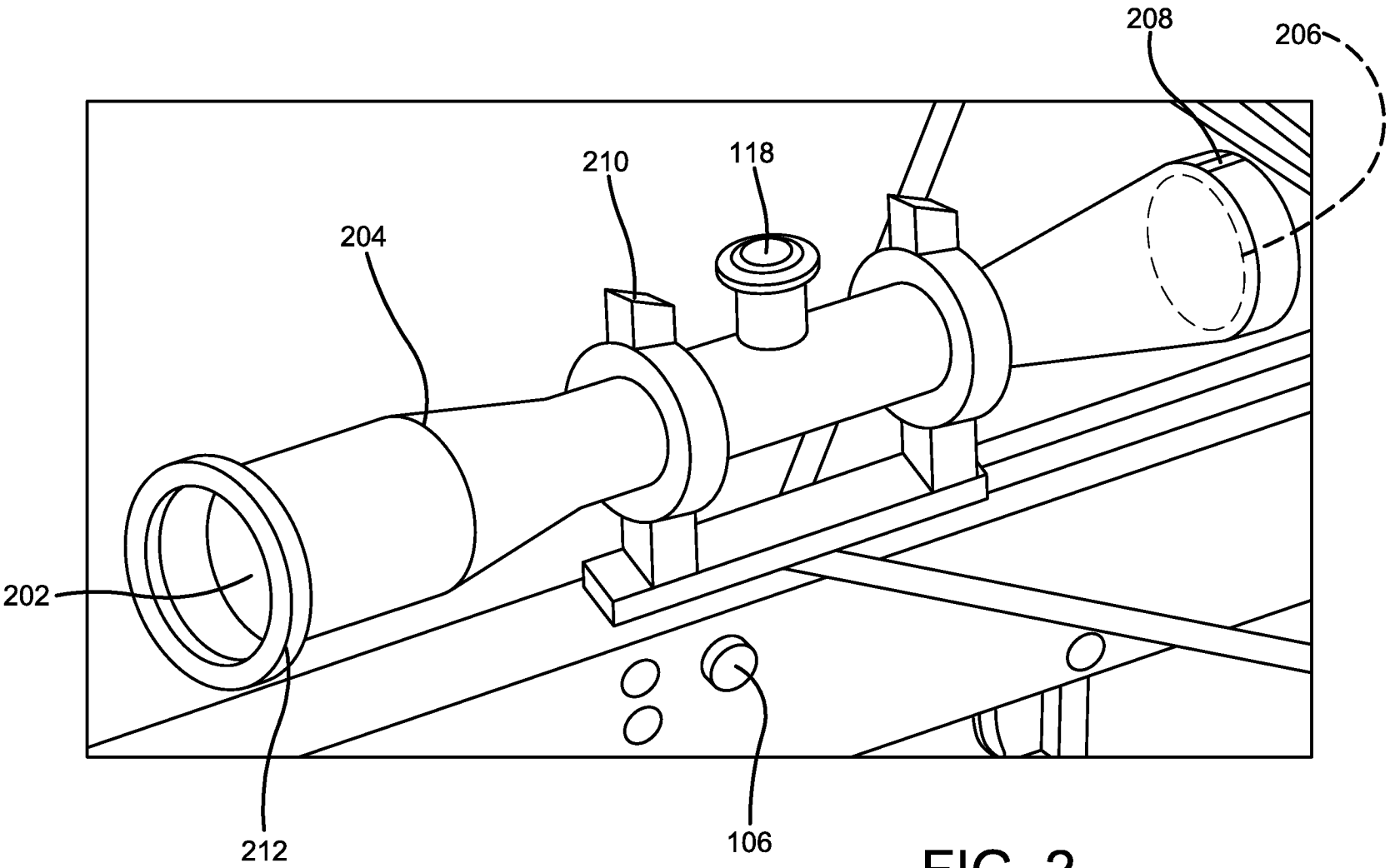
FIG. 2 illustrates a detailed view of one potential embodiment of the rangefinder scope of the present invention in accordance with the disclosed architecture.

FIG. 2 illustrates a detailed view of the rangefinder scope 102 of the present invention in accordance with the disclosed architecture. As stated earlier, the rangefinder scope 102 is activated by pressing the activation button 106 for helping the user to achieve maximum accuracy for a particular shot. The scope 102 has a rangefinder reticle 202 such as a dot reticle for displaying the fine gridlines as best shown in FIG. 4. The reticle display 202 helps the user to determine the target and accuracy of the shot by comparing the target and the shot. The scope 102 is also configured to display additional information such as range and tilt information of the crossbow and the target as best shown in FIG. 4.

The rangefinder scope 102 has an eyepiece lens 212 positioned towards the user of the crossbow 100 and is associated with a focus ring 204. The focus ring 204 is used for modifying the zoom level of the eyepiece lens 212. The eyepiece lens 212 is designed to allow the user to view the reticle 202 through the eyepiece lens 212. The scope 102 has an objective lens 206 positioned opposite to the eyepiece lens 212. The objective lens 206 is used for pointing and aiming towards the target along with the transmitted laser beam and helps the scope 102 in identifying the range and tilt. The processing of the transmitted laser beam and scanning of the target is performed internally in the rangefinder scope 102 using additional components as best described in FIG. 3.

For controlling the intensity and direction of the laser beam, a beam control button 208 is disposed on the scope 102. The beam control button 208 can be pressed by the user for activating, deactivating and changing intensity of the laser beam. For changing the direction in both horizontal and vertical direction without changing the crossbow orientation, the scope 102 has an illumination adjustment knob 210. The knob 210 can be used especially by hunters and other users where there can be space and motion constraints with respect to moving the crossbow for checking the target before firing a shot. The eyepiece 212 also helps in a user viewing a relative size of the target. Both the eyepiece 212 and the objective lens 206 provide variable magnification up to 5×.

The scope 102 can include the conventional windage knob for adjusting the reticle 202 left and right. Similarly, an elevation knob can be used for adjusting the reticle 202 up and down.

Figure 3:
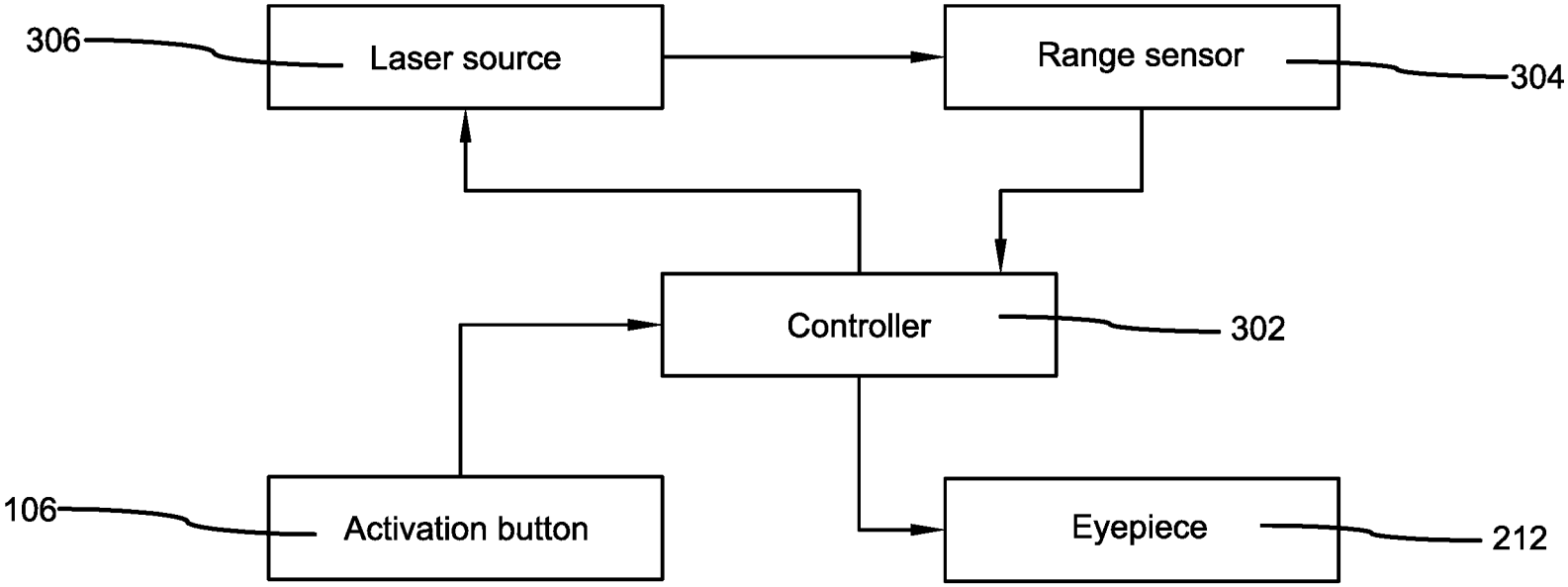
FIG. 3 illustrates a block diagram of the various potential internal components of the rangefinder scope of the present invention that assists the user of the scope in identifying and displaying a range and taking an accurate shot in accordance with the disclosed architecture.
Figure 5:
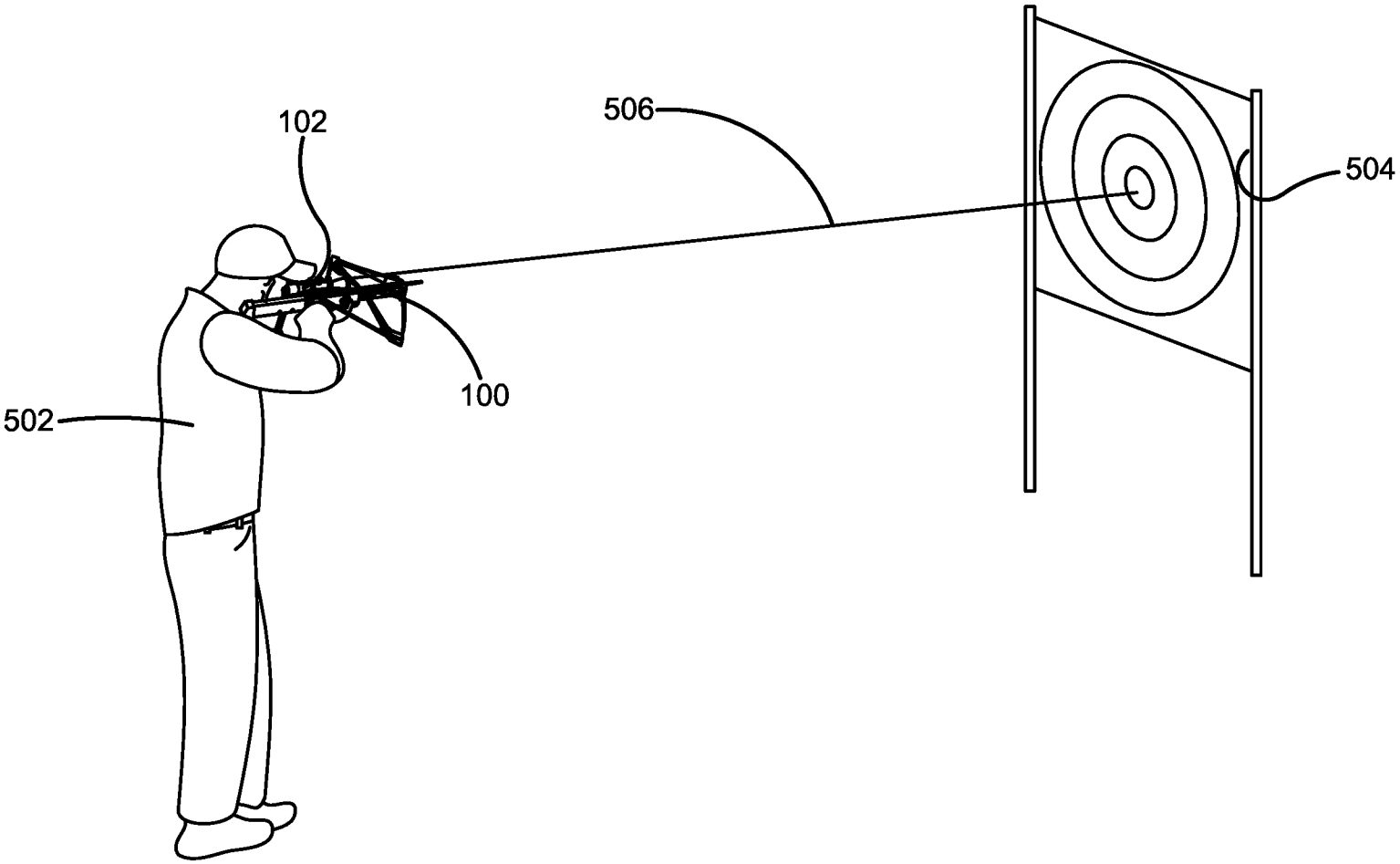
FIG. 5 illustrates a perspective view of a user using a crossbow with one potential embodiment of the integrated rangefinder scope in accordance with the disclosed architecture.

FIG. 3 illustrates a block diagram view showing internal components of the rangefinder scope 102 of the present invention that helps the scope 102 in identifying and displaying range for helping a user to take an accurate shot in accordance with the disclosed architecture. The scope 102 has a laser source emitter 306 in the form of a laser diode for generating a laser beam and transmitting same towards a target as best shown in FIG. 5. The laser source 306 is activated when controller 302 of the scope 102 receives a signal from the activation button 106 upon being pressed by a user. The laser beam transmitted by the laser source 306 is used for finding the distance of the crossbow distance from the target by range sensor 304.

More specifically, the range sensor 304 calculates the time of flight of the laser beam hitting the target and received back by the range sensor 304. The calculated range is also displayed through the eyepiece 212 of the scope as best shown in FIG. 4. The range sensor 304 is also configured to identify tilt of the crossbow 100 relative to the target. The range sensor 304 provides the calculated range and tilt values to the controller 302 which are displayed on the scope 102.

Range sensor 304 may have an internal memory that can store data associated with an associated projectile device (e.g., bow, rifle) and various scientific principle data (e.g., gravitational constants, drag coefficients etc.) for calculating the range and tilt.

The laser source 306 is preferably placed in proximity to the reticle 202. It should be appreciated that the reticle can be red dot elements, other reticles, or green dot elements.

Figure 4B:
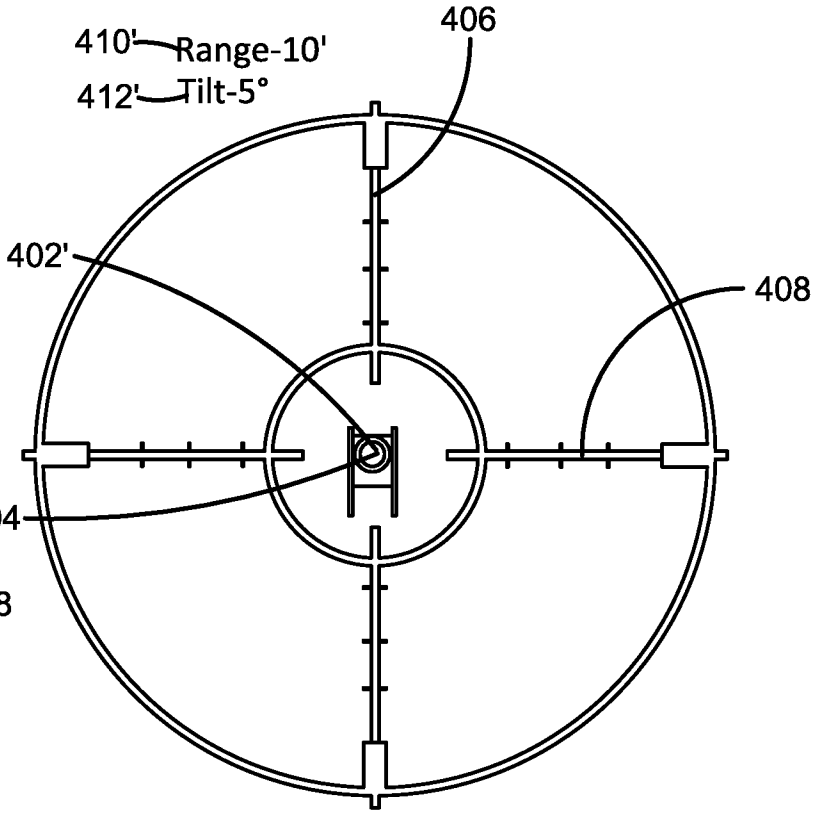
FIG. 4B illustrates a perspective view of one potential embodiment of the rangefinder scope displaying the position of the laser beam pointed at the target in accordance with the disclosed architecture.
Figure 4A:
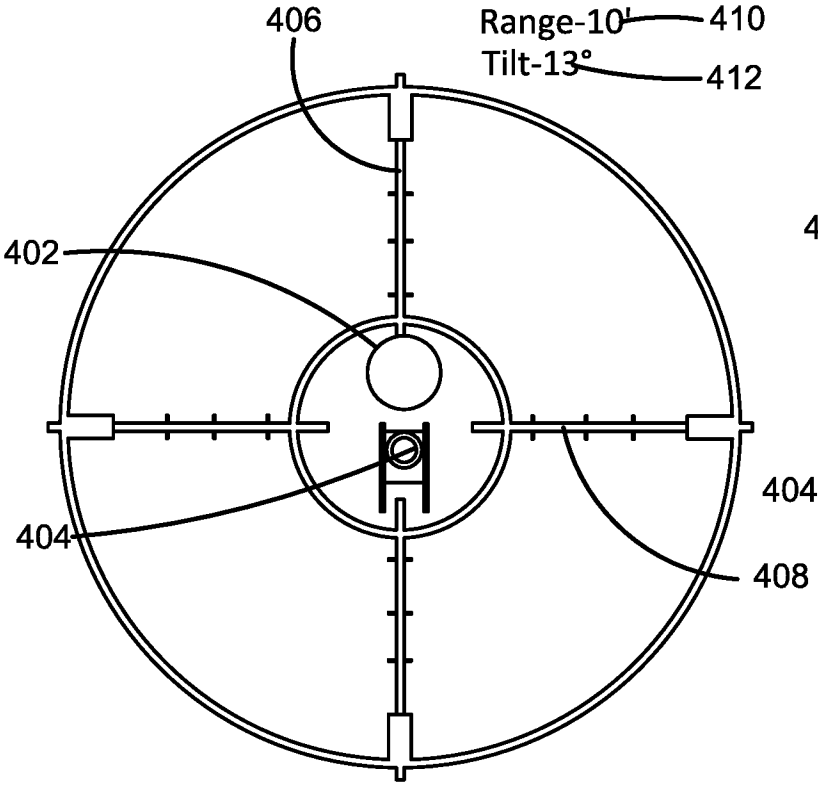
FIG. 4A illustrates a perspective view of one potential embodiment of the rangefinder scope displaying the initial position of the laser beam reticle and the target in accordance with the disclosed architecture.

FIG. 4A illustrates a perspective view showing the rangefinder scope 102 displaying the initial position of the laser beam reticle and the target in accordance with the disclosed architecture. When the crossbow scope 102 is in an activated mode, the eyepiece of the scope 102 displays the laser beam projection 402 and a target image 404. The relative distance between the reticle 402 and the image 404 provide an indication of the accuracy of the potential shot to be taken by a user. The reticle 202 provides vertical guidelines 406 and horizontal guidelines 408 that also aid in ascertaining an accurate potential shot by a user. The zoom level of the projection 402 and the target image 404 can also be changed by the user using the controls provided on the scope 102.

The scope 102 can also be configured to display initial range value 410 of the target from the crossbow on which the scope 102 is integrated or retrofitted. The initial range value is continuously updated as the crossbow is moved or the orientation of the laser beam is changed by a user. The initial tilt value 412 of the target from the crossbow to help a user reorient the crossbow for an accurate shot is also displayed on the scope 102

FIG. 4B illustrates a perspective view showing the rangefinder scope 102 displaying the position of the laser beam pointed at the target in accordance with the disclosed architecture. The user, based on the initial position of the laser beam projection as shown in FIG. 4A, reorients the crossbow for making an accurate potential shot. In reorienting the crossbow, the laser beam projection 402' is pointed at the target 404, thereby ascertaining a potential accurate shot by the user. In the accurate positioning, the final range value 410' and the final tilt value 412' are also displayed.

FIG. 5 illustrates a perspective view of a user using the crossbow 100 with the integrated rangefinder scope 102 towards a target 504 in accordance with the disclosed architecture. The user 502 can use the crossbow 100 for improving accuracy while hunting, during competition, shooting practice and many more. The user 502 can activate the crossbow scope 102 using the activation button 106 (as shown in FIGS. 1 & 2) to adjust the crossbow 100 to accommodate the laser reticle within the sight. The laser can accommodate virtually any distance, even long-range shots.

The rangefinder scope 102 enables the user 502 to adjust the shot to accommodate a long-range arc to hit a target 504 at long range. The scope 102 helps the user with visual indications to make an accurate shot.

In one embodiment of the present invention, the laser reticle can be a physical reticle and alternatively, the reticle can be a virtual reticle projected on the eyepiece lens of the scope 102. Further, in one embodiment, the user 502 can select to use one of the physical or virtual reticles. The laser may be visible to the human eye, but is preferably not visible.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "rangefinder scope", "scope", and "crossbow scope" are interchangeable and refer to the built-in rangefinder crossbow scope 102 of the present invention. Similarly, as used herein "crossbow", "crossbow with built-in laser rangefinder", and "crossbow with integrated laser rangefinder", are interchangeable and refer to the crossbow with built-in laser rangefinder 100 of the present invention.

Notwithstanding the forgoing, the crossbow 100 and rangefinder crossbow scope 102 of the present invention can be of any suitable size and configuration as is known in the art without affecting the overall concept of the invention, provided that it accomplishes the above-stated objectives. One of ordinary skill in the art will appreciate that the crossbow 100 and the rangefinder crossbow scope 102 as shown in the FIGS. are for illustrative purposes only, and that many other sizes and shapes of the crossbow 100 and the rangefinder crossbow scope 102 are well within the scope of the present disclosure. Although the dimensions of the crossbow 100 and the rangefinder crossbow scope 102 are important design parameters for user convenience, the crossbow 100 and the rangefinder crossbow scope 102 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A rangefinder scope mounted to a crossbow, the rangefinder scope comprising:

a laser beam projection comprised of a laser source emitter in the form of a laser diode for generating and projecting said laser beam projection towards a target;

a range sensor, wherein said laser beam projection and said range sensor determine a linear distance between the crossbow and the target, and further wherein said laser beam projection and said range sensor determines a projectile path between the crossbow and the target;

a target image;

a rail for adjustable mounting of said rangefinder scope onto the crossbow;

an actuator for activating said rangefinder scope; and a display for displaying said target image, wherein said display comprises a reticle.

2. The rangefinder scope of claim 1 further comprising a windage knob for adjusting said reticle to a left direction or a right direction.

3. The rangefinder scope of claim 2 further comprising an elevation knob for adjusting said reticle up or down.

4. The rangefinder scope of claim 3, wherein said laser beam projection and said range sensor calculate a desired tilt of the crossbow relative to the target, and wherein said display displays said desired tilt.

5. The rangefinder scope of claim 4, wherein said rangefinder scope comprises an eyepiece lens having a focus ring for modifying a zoom level of said eyepiece lens.

6. The rangefinder scope of claim 5, wherein said rangefinder scope comprises an objective lens positioned at an opposing end to said eyepiece lens, and further wherein said objective lens is for aiming the crossbow towards the target.

7. The rangefinder scope of claim 6, wherein said rangefinder scope comprises a beam control button for controlling an intensity and a direction of the laser beam projection.

8. The rangefinder scope of claim 7, wherein said range sensor calculates a time of flight of said laser beam projection hitting the target and being received back by said range sensor.

9. A rangefinder scope mounted to a crossbow, the rangefinder scope comprising:

a laser beam projection comprised of a laser source emitter in the form of a laser diode for generating and projecting said laser beam projection towards a target;

a range sensor, wherein said laser beam projection and said range sensor calculates a linear distance between the crossbow and the target and a desired tilt of the crossbow relative to the target;

a target image;

a rail for adjustable mounting of said rangefinder scope onto the crossbow;

an actuator for activating said rangefinder scope; and a display for displaying said target image, wherein said display comprises a reticle and displays the desired tilt, and further wherein said display includes said linear distance and said desired tilt of an initial range value between the crossbow and the target.

10. The rangefinder scope of claim 9, wherein said laser beam projection and said range sensor calculate a projectile path between the crossbow and the target.

11. The rangefinder scope of claim 9, wherein said display includes said linear distance and said desired tilt of a continuously updated range value between the crossbow and the target.

12. The rangefinder scope of claim 11 further comprising a windage knob for adjusting said reticle in a left direction or a right direction.

13. The rangefinder scope of claim 12 further comprising an elevation knob for adjusting said reticle up or down.

14. The rangefinder scope of claim 13, wherein said rangefinder scope comprises an eyepiece lens having a focus ring for modifying a zoom level of said eyepiece lens.

15. The rangefinder scope of claim 14, wherein said rangefinder scope comprises an objective lens positioned at an opposing end to said eyepiece lens.

16. The rangefinder scope of claim 15, wherein said rangefinder scope comprises a beam control button for controlling an intensity and a direction of the laser beam projection.

17. The rangefinder scope of claim 16, wherein said range sensor calculates a time of flight of said laser beam projection.

18. A rangefinder scope mounted to a crossbow, the rangefinder scope comprising:

a laser beam projection comprising a laser diode for generating and projecting said laser beam projection towards a target;

a range sensor, wherein said laser beam projection and said range sensor calculate a linear distance between the crossbow and the target and a desired tilt of the crossbow relative to the target;

a target image;

an actuator for activating said rangefinder scope; and a display for displaying said target image, wherein said display comprises a reticle, the linear distance, and the desired tilt of a continuously updated range value between the crossbow and the target.

19. The rangefinder scope of claim 18, wherein said laser beam projection and said range sensor calculate a projectile path between the crossbow and the target.

20. The rangefinder scope of claim 19, wherein said rangefinder scope comprises a beam control button for controlling an intensity and a direction of the laser beam projection.

* * * * *